United States Patent [19]

Buckley et al.

[11] Patent Number: 4,555,361

[45] Date of Patent: Nov. 26, 1985

[54] METHOD OF REDUCING THE VOLUME OF SOLID RADIOACTIVE WASTE

[75] Inventors: Leo P. Buckley; Kenneth A. Burrill, both of Deep River; Conrad D. Desjardins; Robert S. Salter, both of Fredericton, all of Canada

[73] Assignee: Atomic Energy of Canada Limited, Ottawa, Canada

[21] Appl. No.: 495,538

[22] Filed: May 17, 1983

[30] Foreign Application Priority Data

Aug. 8, 1982 [CA] Canada ..... 409849

[51] Int. Cl.[4] ..... G21F 9/14; G21F 9/32

[52] U.S. Cl. ..... 252/626; 252/632

[58] Field of Search ..... 252/630, 631, 632, 626; 237/9 B; 376/370, 371

[56] References Cited

U.S. PATENT DOCUMENTS

| | | | |
|---|---|---|---|
| 4,008,171 | 2/1977 | Tiepel et al. | 252/632 |
| 4,144,186 | 3/1979 | Drobnik et al. | 252/626 |
| 4,203,863 | 5/1980 | Knotik et al. | 252/632 |
| 4,208,298 | 6/1980 | Irie et al. | 252/632 |
| 4,235,738 | 11/1980 | Knotik et al. | 252/626 |
| 4,276,834 | 7/1981 | Bregulla et al. | 252/626 |
| 4,363,780 | 12/1982 | Hannerz | 376/370 |
| 4,404,165 | 9/1983 | Hesky et al. | 376/371 |

FOREIGN PATENT DOCUMENTS

| | | | |
|---|---|---|---|
| 3107022 | 1/1982 | Fed. Rep. of Germany | 252/632 |
| 2080605 | 2/1982 | United Kingdom | 252/626 |

*Primary Examiner*—Ben R. Padgett
*Assistant Examiner*—Howard J. Locker
*Attorney, Agent, or Firm*—Francis W. Lemon

[57] ABSTRACT

Combustible, solid radioactive waste, such as paper, plastics, rubber, cloth and wood, are reduced in volume to an ash residue using pyrohydrolysis, a method which combines pyrolysis of the waste in a vessel at temperatures in the range of 500° to 700° C. and gasification of residual carbon with superheated steam. Pressures of 1.0 to 3.5 MPa are used with steam flows in the range 4 to 50 grams/second/cubic meter so that carbon containing components of the waste are removed as gaseous decomposition products in the form of carbon monoxide and hydrogen leaving an ash residue.

5 Claims, 3 Drawing Figures

METHOD OF REDUCING THE VOLUME OF SOLID RADIOACTIVE WASTE

Figure 1:
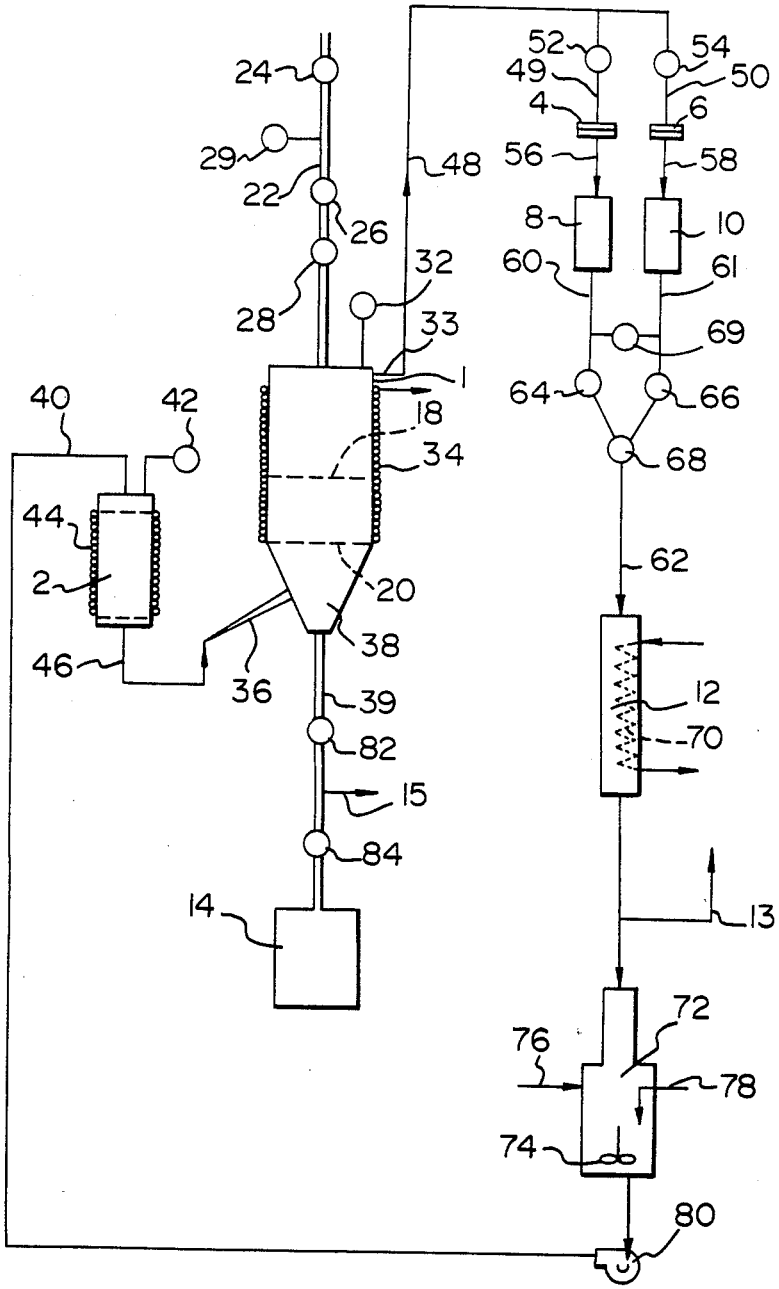

This invention relates to a method of reducing the volume of solid radioactive waste.

Heavy-water-moderated, natural-uranium CANDU power-reactors as single-unit stations generate approximately five 45-gallon drums of noncompacted low level radioactive waste per day. This waste is primarily standard combustible garbage containing cellulose material (e.g. paper), plastics (e.g. disposable gloves, etc.), rubber, cloth and wood. At present, above ground storage of this waste in compacted form is the best cost option for handling. Ultimately, however, although the waste volumes are relatively small, 350 $m^3$/yr, further processing will be required to immobilize the radioactive waste. This is due to requirements for disposal as well as to keep storage costs low. Current technologies available for the reduction of combustible waste volume are complex and expensive. For example, present incineration technology requires a very sophisticated off-handling system due to the large volumes of particulate matter containing radionuclides.

There is a need for a method of reducing the volume of solid radioactive waste wherein:

(i) the off-gas handling is simple;

(ii) the combustion process is endothermic for ease of temperature control;

(iii) it is possible for the system to be contained by recirculating process water or steam;

(iv) the capital investment is low; and (v) the method readily lends itself to automated operation.

According to the present invention, there is provided a method of reducing the volume of solid radioactive waste, comprising:

(a) pyrolyzing the radioactive waste in the interior of a vessel, while (b) passing superheated steam through the vessel at a temperature in the range 500° to 700° C., a pressure in the range 1.0 to 3.5 MPa, and at a flow rate in the range 4 to 50 grams/second/cubic meter of the volume of the vessel interior, to cause pyrohydrolysis of the waste and to remove carbon-containing components of the pyrolyzed waste from the vessel, as gaseous decomposition products in the form of carbon monoxide and hydrogen leaving an ash residue in the vessel;

(c) filtering any entrained particles present with the gaseous decomposition products, (d) removing any acidic vapours present with the gaseous decomposition products by solid sorbent, (e) condensing steam and any organic substances present with the gaseous decomposition products, and (f) removing the ash from the vessel.

The radioactive waste may be deposited upon an upper screen in the vessel, so that at least a substantial portion of the pyrolysis of the radioactive waste takes place while the radioactive waste is on the upper screen, and pyrolyzed waste falls through the upper screen onto a lower screen, where at least a substantial portion of the pyrohydrolysis takes place, and the ash residue falls through the lower screen.

In some embodiments of the present invention, the steam pressure in the vessel is in the range 1.4 to 2.8 MPa and the flow rate of the condensed steam is of the order of 16.7 grams/second/cubic meter of reation the vessel interior.

In other embodiments of the present invention, the superheated steam is obtained by heating and recirculating the condensed steam.

Organic liquid waste may be introduced into the vessel with the recirculated condensed steam.

Figure 2:
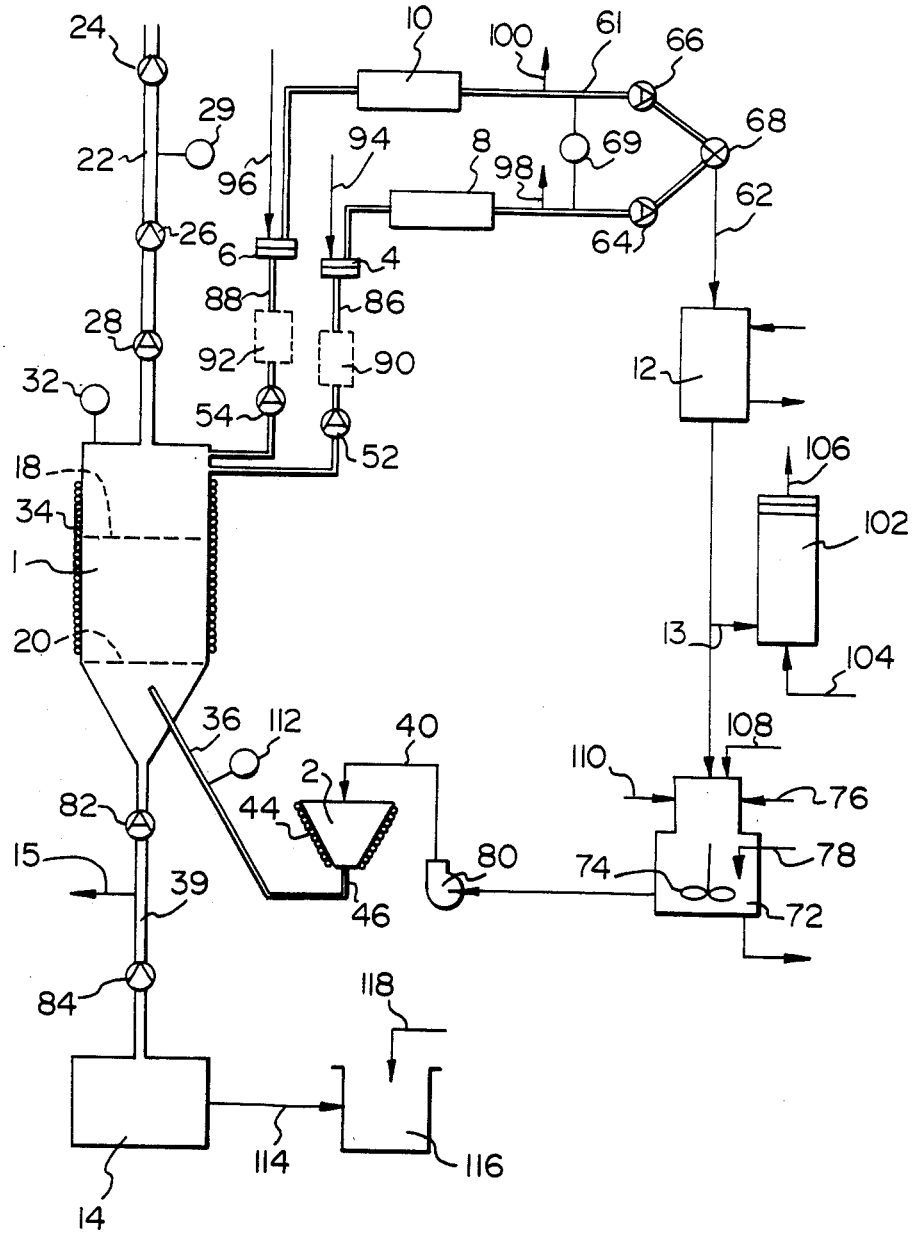
Figure 3:
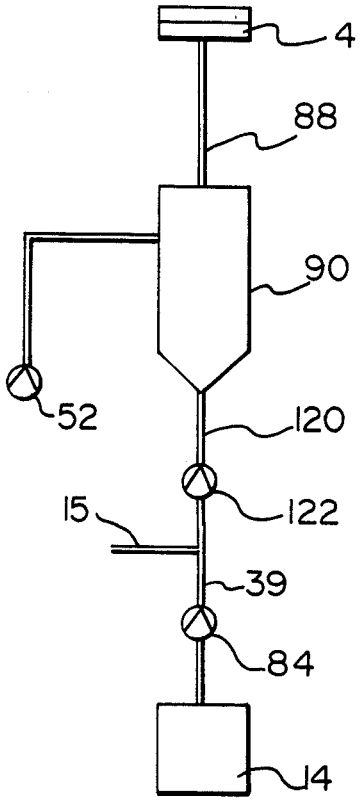

In the accompanying drawings which illustrate, by way of example, embodiments of the present invention, FIG. 1 is a flow diagram for a batch method of reducing the volume of radioactive waste, FIG. 2 is a flow diagram for a semi-continuous method of solid reducing the volume of radioactive waste, and FIG. 3 is a flow diagram of a cyclone shown in FIG. 2.

In FIG. 1 there is generally shown, a reactor vessel 1, a superheated steam generating unit 2, filters 4 and 6, acid vapour absorption cells 8 and 10, a condenser 12, an off-gas pipe 13, an ash discharge vessel 14, and a vacuum line 15.

The vessel 1 has an electrical heating coil 16 therearound and is fitted with two stainless steel screens 18 and 20, which extend thereacross at different heights in an intermediate portion of the vessel 1. A radioactive waste supply pipe 22, containing two ball valves 24 and 26, a gate valve 28, and a pressure gauge 29, is connected to an upper side of the vessel 1. A pressure gauge 32 is connected to the vessel 1 which has a gas outlet 33.

The vessel 1 has an electrical heating coil 34 therearound, a superheated steam inlet pipe 36 thereto, connected to the superheated steam generating unit 2, a lower, ash collecting hopper portion 38 beneath the lowermost screen 20 and an ash discharge line 39.

The superheated steam generating unit 2 has a water supply pipe 40, a pressure gauge 42, an electrical heating coil 44, and a superheated steam outlet 46 connected to the superheated steam inlet pipe 36 of the vessel 1.

The filters 4 and 6 are 0.5 micron mesh size, stainless steel, in-line filters. The filters 4 and 6 are connected to the gas outlet 33 of the vessel 1 by exit pipes 48 to 50 and valves 52 and 54.

The acid vapour absorption cells 8 and 10 are connected by pipes 56 and 58, respectively, to the filters 4 and 6; pipes 60 to 62, valves 64 and 66, and steam control valve 68, to the steam condenser 12. Pipes 60 and 61 are connected to a pressure gauge 69.

The steam condenser 12 is cooled by a water-cooled heat exchange coil 70 and the condensate from the condenser 12 collects in a liquid collector 72. The liquid collector 72 has a condensate stirrer 74, means 76 for adding a dispersement and a pH adjusting device 78. A pump 80 is provided for pumping condensate from the liquid collector 72 and recirculating it to the water supply tube 40 of the superheated steam generating unit 2.

Gate valve 82 and ball valve 84 are provided for intermittently discharging ash from the vessel 1 into the vessel 14.

Radioactive waste from, say, a heavy-water-moderated, natural uranium CANDU power-reactor typically includes paper, polyethylene, polyvinylchloride and cloth, and experiments have been carried out to pyrolyze these materials as a simulated waste in the vessel 1.

In the experiments, these materials were fed on to the top screen 18 in the vessel 1 from the pipe 22, using the valves 24, 26 and 28 to more or less maintain the pressure within the vessel 1. A temperature not exceeding 700° C. was maintained in the vessel 1 using the heating coil 34, while superheated steam, generated in the unit 2 using the heating coil 44, was fed to the vessel 1.

Char product generated on the top screen 18, from the simulated waste, fell to the second screen 20, where the char is converted to ash and falls through the second screen 20 ready for discharge as ash to the vessel 14. Gases produced by pyrolysis of the simulated waste were found to undergo secondary reactions in both the vessel 1 and exit pipes 48 to 50 in the formation of heavy tars, char and a light gas component. Using pressurized, superheated steam produced a complete breakdown of the pyrolysis gas, with substantially no particulate entrainment therein with no evidence of char formation in the exit pipes 48 to 50, which was found to be present when pressurized, superheated steam was not used. This was because the pressurized, superheated steam enabled the endothermic water gas shift reaction to proceed, that is, char or fixed carbon was broken down to gaseous decomposition products in the form of carbon monoxide and hydrogen. This resulted in a high, overall volume reactions of as much as 50:1.

The use of fluid pressure in the reaction vessel 1 was found to provide two advantages. First, by pressurizing the reaction vessel 1, particulate release was minimized. Second, the fluid pressure increased the time that the pyrolysis gases were retained in the vessel 1, and increased the contact period between the steam and the gases. This allowed the water gas shift reaction to proceed more to completion and to elimination char formation and the release of heavy oils.

In some tests, nitrogen was circulated through the vessel 1 and this was removed by the vacuum line 15.

Any entrained ash particles were filtered from the gases by the filters 4 and 6.

HCL vapour in the off-gases was extracted therefrom by the absorption cells 8 and 10 which contained CaO, $Na_2CO_3$ or the like absorbent. The solid absorbent in the cells 8 and 10 was used to remove acidic vapours in preference to liquid scrubbers because less volume of waste was generated. The large volume of liquid waste from scrubbing would require a lot more processing than the solid absorbent. A further advantage is that the solid absorbent can be handled using a similar or the same system to that used to immobilize the ash discharged from vessel 1. The pressure of the off-gases was then reduced to atmospheric pressure using the valves 64, 66 and 68.

A condensible liquid fraction comprising water from steam injection and light organics from incomplete cracking of the off-gases from the vessel 1 were condensed in the condenser 12.

Off-gases were removed by pipe 13 and passed through a filter (not shown).

The condensate from the condenser 12 collects in the collector 72 where the pH was adjusted by control 78 while a dispersant was added by means 76 and mixed with the condensate by stirrer 74 to form an emulsion which was recycled to the superheated steam generating unit 2 by pump 80.

The experiments were carried out at elevated pressures and the simulated waste was added in discrete quantities (batch mode) to the vessel 1. Using a gas pressure in the vessel 1 of the inert gas fed thereto, or by generated pyrolysis gas, in the range 1.0 to 3.5 MPa and a temperature in the range 500° to 700° C. substantially avoided particulate entrainment in the off-gases.

The pyrolysis of simulated waste product, under inert gas pressure or generated pyrolysis gas pressure, using the apparatus shown in FIG. 1, gave an overall volume reduction of at least 20:1 from a charge intially compacted 5:1 by volume. The pyrolysis gases were found to undergo secondary reactions in both the vessel 1 and the pipes 48 to 50 resulting in the formation of heavy tars, char and a light gas component. Tests without pressurized steam produced excessive char build-up throughout the system. Tests carried out using pressurized steam produced a substantially total breakdown of the pyrolysis gases, substantially no particulate entrainment, and substantially no evidence of char formation. Using superheated steam was found to enable the endothermic water gas shift reaction to proceed; that is, char or fixed carbon was broken down to gaseous decomposition products in the form of carbon monoxide and hydrogen so that high overall volume reductions of the order of 50:1 were achieved.

In FIG. 2, similar parts to those shown in FIG. 1 are designated by the same reference numerals and the previous description is relied upon to describe them.

Apparatus based on the flow diagram shown in FIG. 2 was used for experiments wherein the apparatus was operated on a semi-continuous basis.

In FIG. 2, the valves 52 and 54 are situated in pipelines 86 and 88, respectively, which may also contain cyclone separators 90 and 92.

The filters 4 and 6 are provided with nitrogen backflow pipes 94 and 96, respectively, to assist filter cleaning. Bleeds 98 and 100 are provided to allow replacement of the absorbents after they become exhausted.

A filter 102, having an air inlet 104 and an air outlet 106 is connected to the pipe 13.

The collector 72 has an organic liquid waste charging pipe 108 and a water make-up pipe 110.

The pipe 36 has a pressure gauge 112.

The ash discharge vessel 14 has a pneumatic transfer pipe 114 for delivering the ash to an immobilization device, such as ribbon blender 116 provided with a bitumen feed 118.

In FIG. 3, similar parts to those shown in FIG. 2 are designated by the same reference numerals and the previous description is relied upon to describe them.

In FIG. 3, the cyclone separator 90 has a pipeline 120, containing valves 122 and 84, and a vacuum branch pipe 15 for nitrogen flushing the system, connected to the ash discharge vessel 14.

The cyclone separator 92 is connected to the ash discharge pot 14 in the same manner as the cyclone separator 90, is shown connected thereto in FIG. 3.

Organic liquid wastes generated during nuclear reactor operations include heavy oils, which are released from hydraulic and lubricating systems, and scintillation liquids, which are used in the analysis of tritium. It was found that these wastes could be converted to carbon monoxide and hydrogen by introducing them to the collector 72 through pipe 108 where they are mixed with the water, fed back through the superheated steam generating unit 2 by pump 80, and then introduced into the vessel 1. The organic liquids are then subjected to the same processes as the solid wastes and are decomposed to gaseous oxides and hydrogen.

In experiments using the arrangement shown in FIG. 2, the superheated steam generating unit 2 was supplied with steam from two autoclaves (not shown) connected in parallel and valved to permit continuous steam generation. One of the autoclaves was 4 L in capacity and was a primary steam generator. The other autoclave was a back-up steam generator for use when the primary generator was cooling down, being refilled with water and warmed up for steam generation.

The superheated steam generator 2 was a coiled, $\frac{3}{8}$ inch (9.52 mm), stainless steel tube with a parallel winding of electrical heating elements. This generator operated at ~900° C. and ~600 psi (4.1 MPa) yielding a steam temperature at the vessel 1 of ~600° to 700° C., the operating temperature required.

The samples used for semi-continuous trials were 1 g to 8 g compressed charges of cylindrical shape and contained $UO_2$ for evaluating particulate entrainment in the system. The sample charge distribution was 32 w/o paper, 8 w/o PVC, 36 w/o plastic, 12 w/o rubber, 4 w/o cloth and 8 w/o wood.

Normal sample loading involved the following operation sequence:

(i) a cylindrically shaped, compacted charge was dropped between the two ball valves 24 and 26, (ii) with both of the two ball valves 24 and 26 closed, the volume between them was pressurized with $N_2$, from a source not shown, to slightly above the operational pressure, (iii) the gate valve 28 was then opened and then, immediately following, the ball valve 26 was opened, and (iv) the charge then dropped on to the first screen 18 in the vessel 1 and then the gate valve 28 was closed. Both of the ball valves 24 and 26 were opened for visual inspection to ensure that the charge had been introduced properly into the vessel 1.

Product discharge was tested after four day trials. The reactor was cooled to ~100° C. and pressurized to 400 psi with $N_2$. The gate valve 18 in the ash discharge line 39 was opened followed by opening the ball valve 84 so that the ash discharged into the evacuated vessel 14.

Two types of tests were conducted. In the first case, the operating variables of temperature, pressure and steam flow were pre-set. A summary of the tests completed and the results achieved are given in Table 1. The actual experimental design was of a factorial type where temperature ranged from 500° to 650° C., steam pressure ranged from 0 to 400 psi (0 to 2.8 MPa) and steam flow ranged from 1.0 to 4.0 cc/min. (condensed steam). By choosing high and low point combinations, an efficient optimization of operating parameters was obtained.

In the second type of tests, variation of one or more operating parameters during the experiment was attempted. The purpose of these tests was to assess the influence of small operating parameter changes. Steam leaks were detected in some cases, however, data obtained prior to leakage remains valid. An overall summary of these tests is given in Table 2. Data abstracted from experiments C-11 to C-19 gave valuable information on the interplay of temperature, pressure and steam flow. These interactions have been summarized in Tables 3, 4, 5, 6 and 7.

The semicontinuous trials were also performed to gather further information about the process. The vessel 1 was kept hot and pressurized and approximately every 3 to 5 hours, a similar waste package to that previously described was placed into the vessel 1 using valves 24, 26 and 28 on the feed line 22. Trial operations for periods of up to 96 hours were carried out with further variations in temperature, pressure and steam flow and these were found to generate volume reductions of 25:1 and weight reductions of 93%. The results of the semi-continuous trials are summarized in Table 7.

At the conclusion of these tests, an analysis of batch versus semi-continuous processes was made. Table 8 outlines the advantages and disadvantages of batch and semi-continuous pyrohydrolysis systems.

TABLE 1

BATCH PYROHYDROLYSIS TESTS - TYPE 1

| Experiment | Temperature °C. | Pressure psi | Pressure MPa | Retention time at T = 500° C. hours | Condensed steam flow cc/min | Reduction weight % | Reduction volume % |
|---|---|---|---|---|---|---|---|
| C-1 | 650 | 400 | 2.8 | 10¼ | 2.0 | 80 | 81 |
| C-3 | 650 | 400 | 2.8 | 7 | 2.0 | 85 | 85 |
| C-4 | 650 | 400 | 2.8 | 12 | 1.5 | 80 | 79 |
| C-5 | 650 | 200 | 1.4 | 12 | 2.2 | 72 | 82 |
| C-6 | 600 | 100 | 0.7 | 13 | 1.6 | 79[2] | 78[2] |
| C-8 | 500 | 0 | 0 | 12 | 2.2 | 78[2] | 82[2] |
| C-9 | 500 | 200 | 1.4 | 12 | 4.0 | 74 | 79 |
| C-10 | 650 | 400 | 2.8 | 12 | 3.75 | 75 | 81 |

NOTES:
[1]C-7 and C-2 failed due to leaking gasket.
[2]Blowout of material observed yielding higher weight losses.
[3]Steam flow is in cc/min of water overflow from impingers (condensed steam).

TABLE 2

PYROHYDROLYSIS TESTS - TYPE 2

| Experiment | Temperature °C. | Pressure psi | Pressure MPa | Retention time at T = 500° C. hours | Condensed steam flow cc/min | Reduction weight % | Reduction volume % |
|---|---|---|---|---|---|---|---|
| C-11 | 500–700 | 200–400 | 1.4–2.8 | 12h | 3.5–4.5 | 86 | 87 |
| C-13 | 500–700 | 200–400 | 1.4–2.8 | 12h | 2.2 (avg) | 90 | — |
| C-14 | 700 | 400 | 2.8 | 12h | 2.4 (avg) | 83 | — |
| C-15 | 650 | 400 | 2.8 | 5h | 1.5 | 75 | — |
| C-16 | 650 | 200–400 | 1.4–2.8 | 12h | 2.0 | 75 | — |
| C-17 | 650 | 200–400 | 1.4–2.8 | 12h | 1.8–6.5 | 83 | — |
| C-18 | 650 | 200–400 | 1.4–2.8 | 12h | 1.0–4.0 | 81 | 83 |

TABLE 2-continued

PYROHYDROLYSIS TESTS - TYPE 2

| Experiment | Temperature °C. | Pressure psi | Pressure MPa | Retention time at T = 500° C. hours | Condensed steam flow cc/min | Reduction weight % | Reduction volume % |
|---|---|---|---|---|---|---|---|
| C-19 | 650 | 200–400 | 1.4–2.8 | 12h | 0–4.0 | 82 | — |

NOTES:
[1]Experimate C-12 failed, and C-13 to 16 showed steam leaks.
[2]C-18 & 19 used an aluminum-asbestos gasket.
[3]C-17 showed a hydrogen leak.
[4]Ranges quoted for operating parameters are controlled variations to assess relationships between each parameter and the reaction rate as determined by product gas flowmeter readings.

TABLE 3

VARIANCE OF FLOW WITH PRESSURE FOR A 4.5 h PERIOD - EXP. C-16

| Time | Temperature °C. | Pressure psi | Pressure MPa | Condensed Steam Flow (cc/min) | Rotameter Gas Flow (cc/min) |
|---|---|---|---|---|---|
| 7 hr | 650 | 300 | 2.1 | 2.0 | 69.0[1] |
| ↓ | 650 | 200 | 1.4 | 2.0 | 26.5 |
| ↓ | 650 | 300 | 2.1 | 2.0 | 23.0 |
| ↓ | 650 | 200 | 1.4 | 2.0 | 24.0 |
| 11.5 hr | 650 | 400 | 2.8 | 2.0 | 15.0[2] |

Note:
[1]High initial flow due to insufficient purging of pyrolysis gases from first phase.
[2]System leak had developed.

TABLE 4

VARIANCE OF FLOW WITH PRESSURE OVER A 9 h PERIOD - EXP. C-18

| Time | Temperature °C. | Pressure psi | Pressure MPa | Condensed Steam Flow (cc/min) | Rotameter Gas Flow (cc/min) |
|---|---|---|---|---|---|
| 7 hr | 655 | 400 | 2.8 | 4 | 35 |
| ↓ | 656 | 320 | 2.2 | 4 | 30 |
| ↓ | 650 | 200 | 1.4 | 4 | 25 |
| ↓ | 650 | 400 | 2.8 | 4 | 37.5 |
| ↓ | 650 | 300 | 2.1 | 4 | 35 |
| ↓ | 650 | 400 | 2.8 | 4 | 40 |
| ↓ | 650 | 200 | 1.4 | 3 | 22 |
| 16 hr | 650 | 200 | 1.4 | 2 | 18 |

Note:
[1]Shows decrease in water gas flow with decreasing pressure and steam flow rate.

TABLE 5

VARYING PRESSURE AND STEAM OVER A 4 h PERIOD - EXP. C-19

| Time | Temperature °C. | Pressure psi | Pressure MPa | Condensed Steam Flow (cc/min) | Rotameter Gas Flow (cc/min) |
|---|---|---|---|---|---|
| ↓ | 655 | 200 | 1.4 | 3 | 22.5 |
| ↓ | 655 | 220 | 1.5 | 4 | 23.5 |

TABLE 5-continued

VARYING PRESSURE AND STEAM OVER A 4 h PERIOD - EXP. C-19

| Time | Temperature °C. | Pressure psi | Pressure MPa | Condensed Steam Flow (cc/min) | Rotameter Gas Flow (cc/min) |
|---|---|---|---|---|---|
| ↓ | 654 | 220 | 1.5 | 3 | 22.5 |
| ↓ | 651 | 220 | 1.5 | 4 | 25.0 |
| ↓ | 652 | 320 | 2.2 | 4 | 27.5 |
| ↓ | 651 | 400 | 2.8 | 4 | 30.5 |
| ↓ | 655 | 300 | 2.1 | 4 | 27.5 |
| Readings taken at ½ hour intervals after first ½ hour of operation. | 655 | 220 | 1.5 | 4 | 22.5 |

Note:
[1]Sampling occurring over 15–30 min intervals
[2]Results shown for all tests are with increasing time
[3]Decreasing flow and pressure confirms results of C-18

TABLE 6

DEPENDENCE OF GAS FLOW RATE ON TEMPERATURE - EXP. C-11

| Time | Temperature °C. | Pressure psi | Pressure MPa | Condensed Steam Flow (cc/min) | Rotameter Gas Flow (cc/min) |
|---|---|---|---|---|---|
| ↓ | 600 | 400 | 2.8 | 4 | 2.5 |
| ↓ | 625 | 400 | 2.8 | 4 | 12.5 |
| ↓ | 650 | 400 | 2.8 | 4 | 22.0 |
| ↓ | 675 | 400 | 2.8 | 4 | 57.5 |
| ↓ | 683 | 400 | 2.8 | 4 | 63.0 |
| ↓ | 680 | 200 | 1.4 | 4 | 47.5 |
| ↓ | 695 | 200 | 1.4 | 4 | 52.5 |
| ↓ | 691 | 400 | 2.8 | 4.5 | 65.0 |
| Readings taken at ½ hour intervals after first ½ hour of operation. | 700 | 400 | 2.8 | 5.0 | 72.0 |

Note:
[1]Substantial increase of water gas with increasing temperature

TABLE 7

SEMI-CONTINUOUS TRIALS

| Trial No. | Charge[1] Total Wt. (g) | Charge[1] No. of Charges | Charge[1] Avg. Sampling weight (g) | Duration (in hr.) | Reactor Operating Conditions Temp. (°C.) | Reactor Operating Conditions Pressure (MPa) | Reactor Operating Conditions Steam flow cc $H_2O$ | Charge Reductions Weight[2] | Charge Reductions Vol.[3] | Charge Reductions Vol.[4] |
|---|---|---|---|---|---|---|---|---|---|---|
| I | 55 | 25 | 2.2 (1.1 to 6.8) | 80 | 650 | 1.5 | 1.6 | 87 | — | — |
| II | 173 | 40 | 4.8 (2.2 to 8.6) | 96 | 650 | 1.5 | 1.2 | 93 | 90 | 96 |
| III | 122 | 25 | 4.9 (4.6 to 6.1) | 66 | 650 | 1.5 | 0.9 | 84 | — | — |

[1]Charge consisted of 32% paper, 8% PVC, 34% plastic, 12% rubber, 4% cloth and 8% wood; 0.125 g $UO_2$ added per gram charge.
[2]This value is calculated after removing the weight of $UO_2$ and stainless steel corrosion product.
[3]Based on 10 ton compression with rebound. Ratio of compacted charge volumes before and after test.
[4]Recalculated with initial charge not compacted.

TABLE 8

COMPARISON OF BATCH vs SEMI-CONTINUOUS PYROHYDROLYSIS OPTIONS

| Batch | Semi-Continuous |
|---|---|
| Advantages | Advantages |
| 1. Simple system | 1. Higher volume reduction (longer retention per charge) |
| 2. Accepts either loose or compacted charges of waste | 2. Significant reduction in capital cost (small volume reactor vessel) |
| 3. Clean off-gas (no particle entrainment) | 3. No special treatment of off-gases (no after burner required) |
| | 4. Less maintenance (thermal cycling reduced) |
| Disadvantages | Disadvantages |
| 1. Capital intensive (requires a large pressure vessel) | 1. Requires a pressurized feed system |
| 2. High maintenance costs associated with thermal cycling | |
| 3. Further treatment of off-gases with an afterburner | |
| 4. High operating costs (gasket replacement & heating large vessel) | |

We claim:

1. A method of reducing the volume of solid radioactive waste, comprising:

(a) pyrolyzing the radioactive waste in the interior of a vessel, while (b) passing superheated steam through the vessel at a temperature in the range 500° to 700° C., a pressure in the range 1.0 to 3.5 MPa, and at a flow rate in the range 4 to 50 grams/second/cubic meter of the volume of the vessel interior, to cause pyrohydrolysis of the waste and to remove carbon-containing components of the waste from the vessel as gaseous decomposition products in the form of carbon monoxide and hydrogen leaving an ash residue in the vessel, (c) filtering any entrained particles present with the gaseous decomposition products, (d) removing any acidic vapours present with the gaseous decomposition products by solid sorbent, (e) condensing steam and any organic substances present with the gaseous decomposition products, and (f) removing the ash residue from the vessel.

2. A method according to claim 1, wherein the radioactive waste is deposited upon an upper screen in the vessel, at least a substantial portion of the pyrolysis of the radioactive waste takes place while the radioactive waste is on the upper screen, pyrolyzed waste falls through the upper screen on to a lower screen, at least a substantial portion of the pyrohydrolysis takes place on the lower screen, and the ash residue falls through the lower screen.

3. A method according to claim 1, wherein the steam pressure in the vessel is in the range 1.4 to 2.8 MPa and the flow rate of the condensed steam is of the order of 16.7 grams/second/cubic meter of reaction the vessel interior.

4. A method according to claim 1, wherein the superheated steam is obtained by heating and recirculating the condensed steam.

5. A method according to claim 4, wherein organic liquid waste is introduced into the vessel with the recirculated, condensed steam.

* * * * *